United States Patent [19]

Vanderford

[11] 4,190,270

[45] Feb. 26, 1980

[54] TUBING HANGER FOR TEMPERATURE VARIATIONS AND EXTREMES

[75] Inventor: Delbert E. Vanderford, Houston, Tex.

[73] Assignee: Cameron Iron Works, Inc., Houston, Tex.

[21] Appl. No.: 865,837

[22] Filed: Dec. 30, 1977

[51] Int. Cl.[2] ..... F16L 21/00

[52] U.S. Cl. ..... 285/142; 285/336; 285/348; 285/DIG. 18

[58] Field of Search ..... 285/143, 142, 140, 348, 285/DIG. 18, 144, 145, 336

[56] References Cited

U.S. PATENT DOCUMENTS

| | | | |
|---|---|---|---|
| 2,046,579 | 7/1936 | Penick et al. | 285/142 |
| 3,025,083 | 3/1962 | Lebeaux | 285/142 X |
| 3,166,345 | 1/1965 | Pinkard | 285/142 X |
| 4,056,272 | 11/1977 | Morrill | 285/140 |

*Primary Examiner*—Thomas F. Callaghan
*Attorney, Agent, or Firm*—Vinson & Elkins

[57] ABSTRACT

A hanger for supporting tubing in a well head including a tubular body adapted for connection to a casing head and having a tapered and upwardly facing seat, a tubular hanger positioned within the body and supported on the seat, a downwardly converging annular space between facing portions on the exterior of the hanger and on the interior of the body, a metal seal ring positioned within the converging space, a seal actuator sleeve positioned between the hanger and the body and being movable axially to engage the seal ring, and a wedging screw extending through the body. The wedging screw engages the seal actuator sleeve and wedges the seal actuator sleeve onto the seal whereby the seal is forced into sealing engagement in the converging space between the hanger and the body.

9 Claims, 3 Drawing Figures

TUBING HANGER FOR TEMPERATURE VARIATIONS AND EXTREMES

BACKGROUND

The present invention relates to an improved hanger and seal suitable for use in conditions of wide variations in and extremes of temperature. The maintenance of a proper seal under such conditions of temperature variations has proven to be a problem. Such temperature conditions could be experienced in production in Alaska (−75° F. to 250° F.) and in steam injection applications (up to 650° F.).

The use of elastomer seals has not been satisfactory for such temperature conditions because the elastomers are subject to breakdown and they have expansion and contraction rates which differ substantially from those rates of the mating metal parts. Temperature cycling has caused elastomers to break down so that they crack or lose desirable qualities such as shape and durometer hardness. Also, resilient seals are often adversely affected by well bore fluids.

Metal seals have been used and even though they may be inert to well bore fluids they have been subject to problems by virtue of being distorted or crushed by differential expansion of the parts to such an extent as to fail to seal when reversal of the temperature results in contraction of the parts. Most metal seals are compression seals and do not have any provision to limit crushing of the seal ring due to differential expansion and contraction of the mating parts resulting from temperature variances.

SUMMARY

The present invention provides an improved hanger seal in which provision is made to assure that the seal is maintained by a metal seal ring after it has been subject to temperature extremes and temperature variations.

An object is to provide an improved tubing hanger having a sealing structure which withstands temperature extremes and variations to maintain a seal between the hanger and the head.

Another object is to provide an improved hanger seal which can be quickly and easily moved into firm sealing engagement after it has undergone temperature cycling and extremes of temperature.

BRIEF DESCRIPTION OF THE DRAWINGS

These and other objects and advantages of the present invention are hereinafter set forth and explained with reference to the drawings wherein.

DESCRIPTION OF THE PRIOR ART

Figure 1:
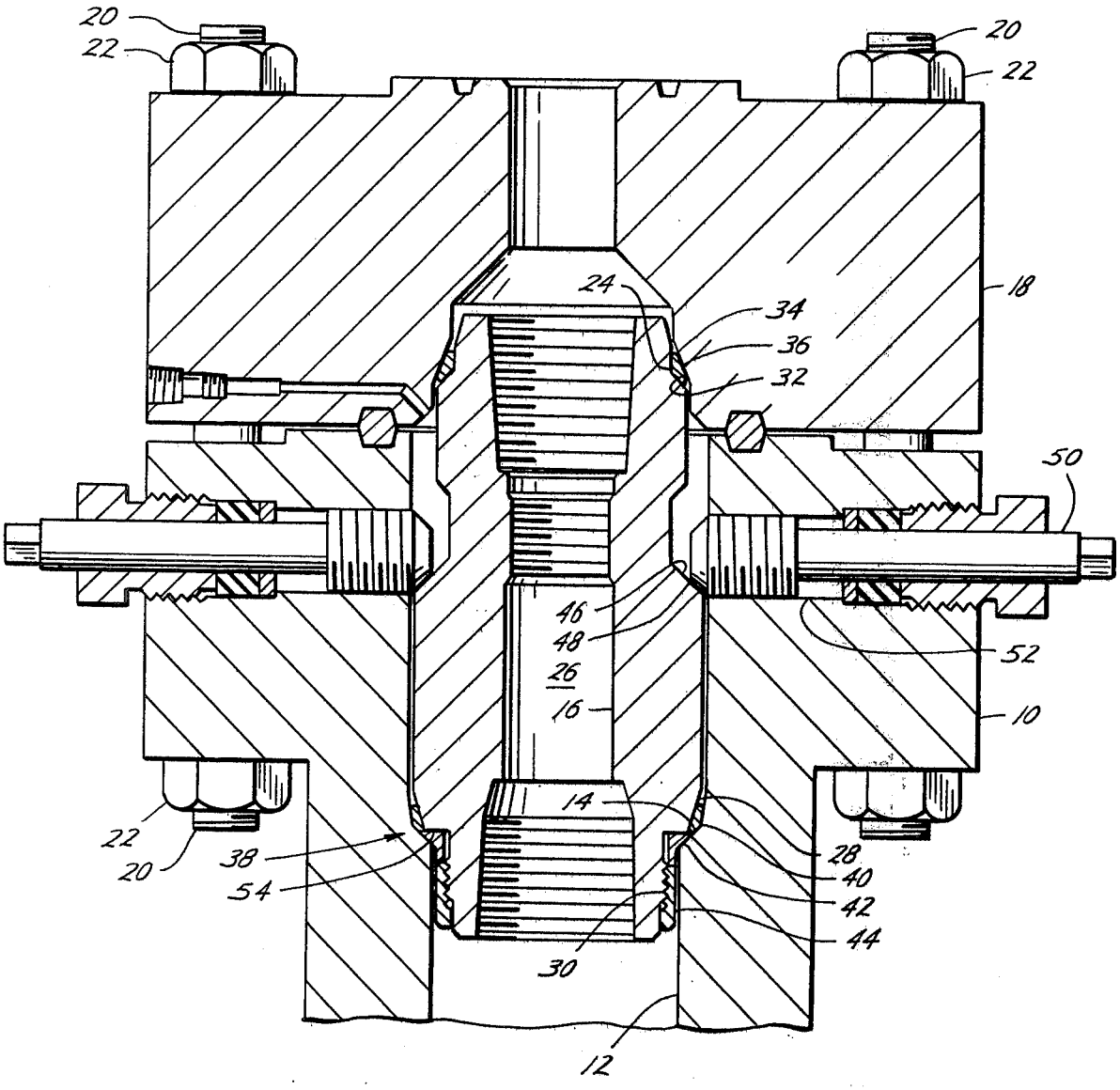
PRIOR ART Fig. 1
FIG. 1 is a vertical sectional view of a hanger seal structure of the prior art.

The prior art hanger structure illustrated in FIG. 1 includes a head or body 10 having a central bore 12 therethrough and the tapered upward facing shoulder 14 which forms the seat on which the hanger 16 is supported. The seal flange 18 is secured to body 10 by the studs 20 and nuts 22 and has an internal tapered surface 24 facing downward.

The hanger 16 has a central bore 26 therethrough, a downward and inward exterior taper 28 with threads 30 below taper 28 and upper tapered exterior surfaces 32 and 34. The upper gasket ring 36 is positioned against surfaces 32, 34 and 24 to seal between the upper exterior of hanger 16 and the interior of seal flange 18. The sealing assembly 38 provides a seal between the lower exterior of hanger 16 and the interior seat 14 of body 10. The sealing assembly 38 includes the ring gasket 40, the back-up ring 42 and the retaining nut 44. The interior of body 10 immediately above seat 14 is slightly tapered to confine the ring gasket 40 as it is forced into sealing engagement. Retaining nut 44 is threaded into the hanger threads 30.

To maintain sealed position of the sealing assembly 38 the intermediate exterior surface of hanger 16 has the surface 46 which tapers upward and inward and coacts with the tapered surface 48 on the end of the tie-down pin 50. Pin 50 extends through the pin opening 52 in body 10 and is provided with a means, such as threads (not shown) for moving inwardly and exerting a downward force on hanger 16. The movement of hanger 16 downward wedges ring gasket 40 into tight sealing engagement.

While the structure shown in FIG. 1 includes metal seals 36 and 40 and pin 50 which can further wedge the ring gasket 40 into tighter sealing engagement if gasket 40 should happen to be crushed by temperature variations or extremes such wedging movement tends to unseat the gasket ring 36. Also, if the hanger shoulder 54 bottoms on the back-up ring 42 further movement of hanger 16 may reduce the effectiveness of sealing assembly 38 by crushing ring 42.

Figure 2:
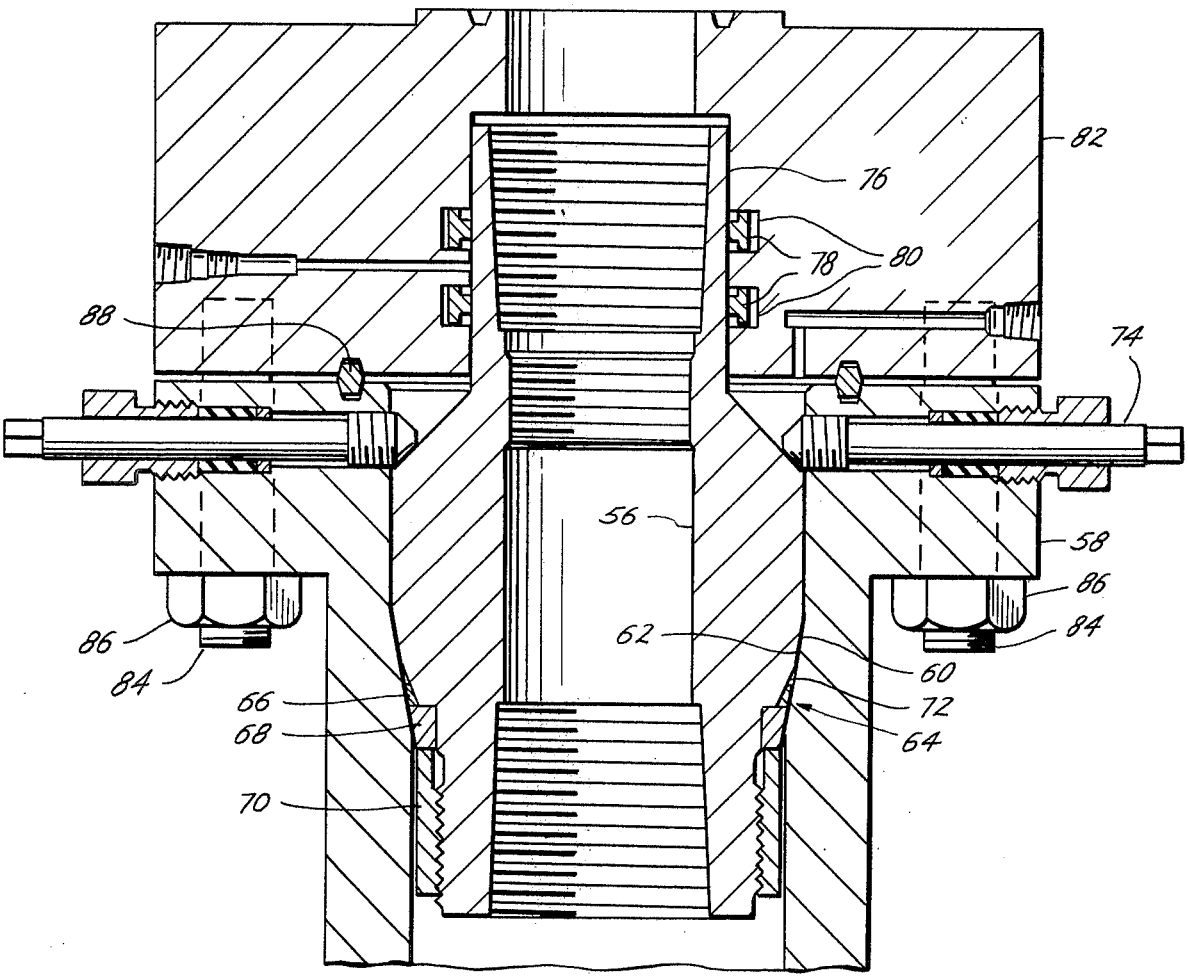
PRIOR ART Fig. 2
FIG. 2 is a vertical sectional view of another hanger seal structure of the prior art.

Another prior art hanger structure is illustrated in FIG. 2 wherein hanger 56 is supported within body 58. The external tapered seating surface 60 on hanger 56 engages the internal tapered surface 62 on body 58 to support hanger 56. The sealing assembly 64, including metal ring gasket 66, back-up ring 68 and nut 70 positions gasket 66 between tapered surface 72 on hanger 56 and surface 62 in body 58 so that gasket 66 is in tight sealing engagement when the seating surface 72 on hanger 56 engages the surface 62 on body 58. Tiedown pins 74 extend through body 58 and retain hanger 56 in its sealed, seated position.

The upper end of hanger 56 has an external cylindrical surface 76 against which the elastomeric seals 78 seal. Seals 78 are positioned in annular recesses 80 in upper flange 82. Upper flange 82 is suitably secured to body 58 by studs 84 and nuts 86 with metal seal ring 88 providing the seal between opposing flange faces of body 58 and flange 82.

While the upper end of hanger 56 may slide within the seal rings 78, such seal rings 78 being elastomeric are not suitable for temperature extremes or temperature cycling. Also, there is no provision short of replacing the sealing assembly 64 to accommodate for the crushing of the seal ring or gasket 66 as a result of temperature variations or extremes since pins 74 can not force hanger 56 further downward once surface 60 is in engagement with surface 62.

DESCRIPTION OF THE PREFERRED EMBODIMENT

Figure 3:
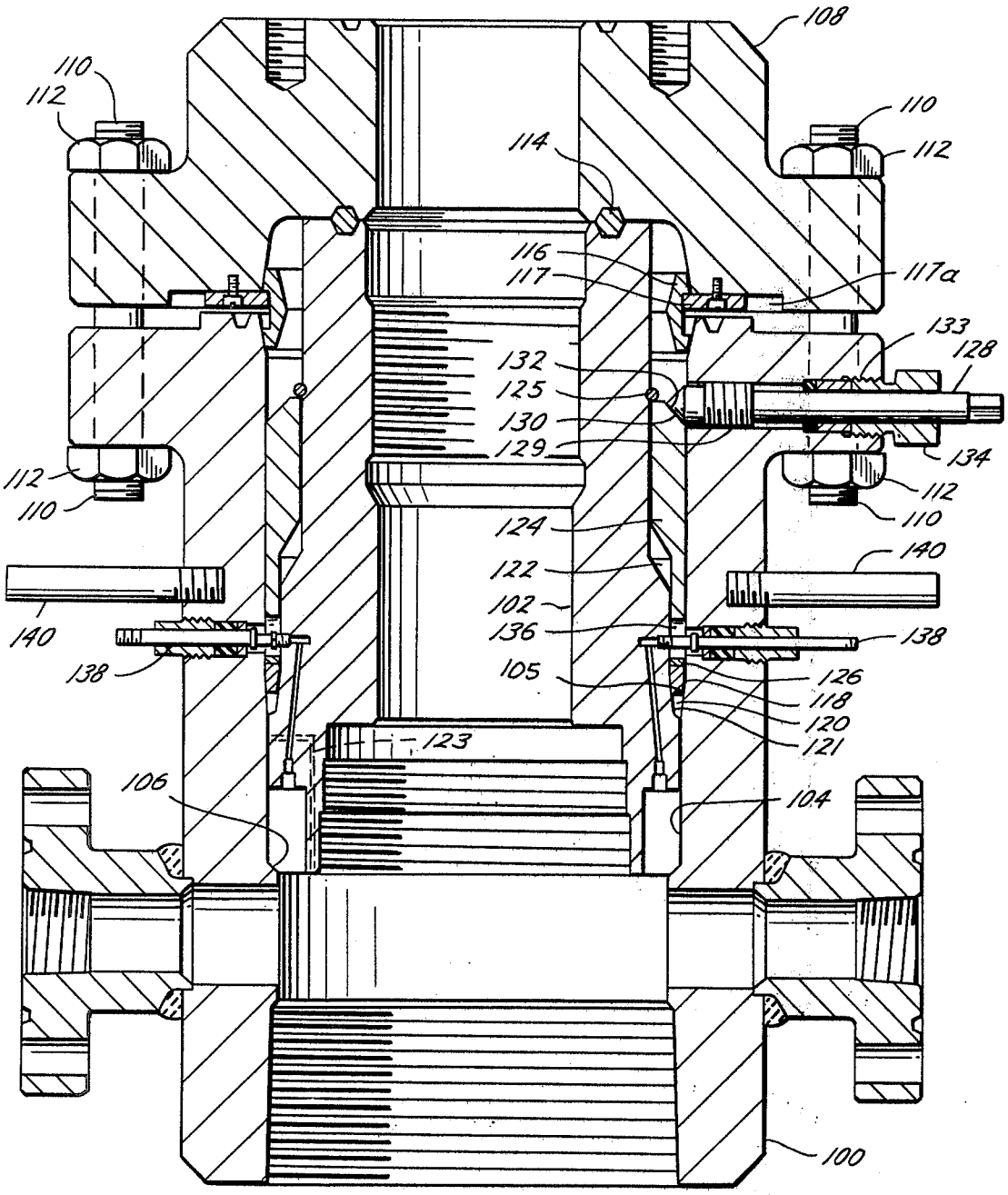
FIG. 3 is a vertical sectional view of the improved hanger seal structure of the present invention.

The improved hanger structure and improved seal structure of the present invention are illustrated in FIG. 3. The head or body 100 is adapted to be connected to the upper end of a casing string (not shown) as by welding or other suitable means. The hanger 102 is supported within the central bore 104 of body 100 on the tapered shoulder or seat 106. The seal flange 108 is secured to the body 100 by the studs 110 and nuts 112. The seal ring 114 is a standard BX type of API seal and seals between the upper end of hanger 102 and the lower face of seal flange 108 as shown. The seal ring 116 seals between the inner tapered faces of seal flange 108 and body 100 as shown. Both seal rings 114 and 116 are suitable metal seals which are not attacked or weakened by the temperature extremes and variations and the well fluids to which they are exposed. Seal ring 116 is loosely retained against vertical movement by dogs 117 located on its outer diameter and fitting into recesses 117*a* formed between seal flange 108 and body 100.

To provide a seal between the exterior of hanger 102 and the interior of body 100 the metal seal ring 118 is positioned within the downwardly converging annular space 120 between the central bore 104 of body 100 and the hanger 102. More specifically, downwardly converging annular space 120 is between upwardly facing tapered surface 105 on central bore 104 and upwardly facing tapered surface 121 on hanger 102. This converging annular space 120 is free of any shoulders or other obstructions which would interfere with movement of seal ring 118. Therefore, the seal ring 118 is freely movable in the converging annular space 120 until it engages tapered surfaces 105 and 121. Immediately above the tapered space 120, the external diameter of hanger 102 is further reduced to provide the enlarged annular space 122. Pressure equalizing part 123 connects space 120 with bore 104.

The seal ring 118 is set into sealing engagement by the downward movement of the sleeve 124 which has its upper portion in space 122 and a lower portion or depending rim 126 in engagement with the upper surface of seal ring 118. The movement of sleeve 124 is caused by the inward movement of actuator pins 128 so that their conical points 130 engage the upper tapered surface 132 on sleeve 124 to wedge sleeve 124 downwardly. Pin 128 is in threaded engagement through the wall of body 100 at 129 and is provided with an annular seal 133 which is tightened into sealing engagement around pin 128 by gland nut 134. The lower portion of sleeve 124 has slots 136 to allow control line plugs 138 to be connected through body 100 and sleeve 124 into hanger 102 as shown. Pins 140 are provided to protect the control line plugs 138. Sleeve 124 is held to hanger 102 by retainer ring 125 mounted in the reduced diameter of hanger 102 approximately level with the top of pin 128.

With the improved structure of the present invention all of the seals are metallic such as 316 stainless steel, and are not subject to deterioration by contact with the well fluids. The hanger, body and seal flange are all preferably constructed of an alloy steel such as a 4000 series alloy steel. Further when the structure is subjected to extremes of temperature and temperature cycling it is not crushed and it is easily and quickly moved back into sealing engagement by the action of the actuator pin 128. The hanger 102 with the sleeve 124 mounted thereon may be run into position with conventional tools.

Since the differential expansion of the hanger is carried by the studs 110, there is no appreciable movement tending to crush the seal ring 118. Also, any slight crushing can easily be accommodated by the rotation of pin 128.

Thus, the improved tubing hanger of the present invention provides a structure in which it is relatively easy to maintain a seal between the hanger and the body under wide variations of temperature and extremes of temperature. Also, any crushing of the metallic seal ring may be easily corrected by moving the sleeve downward thereon to bring it back into firm sealing engagement without changing or interferring with the other seals.

What is claimed is:

1. A hanger comprising a body having a central bore with an upwardly facing seat therein, a tubular hanger positioned within said central bore on said seat, an annular converging space free of obstructions and located between the interior of said body and the exterior of said hanger, a metal seal ring in said converging annular space and freely movable therein in the direction of convergence until said seal ring engages the interior of said body and the exterior of said hanger, a sleeve around a portion of the exterior of said hanger, engaging said seal ring and slidable axially on said hanger, and means extending through the wall of said body engaging and exerting a force on said sleeve whereby said sleeve is driven in the direction of convergence of said space until said seal ring is forced into sealing engagement between said hanger and said body, said sealing ring moving axially to sealing engagement with its inner and outer surfaces being maintained substantially parallel to the sides of said converging annular space and when in sealing engagement at least a portion of said converging annular space extending beyond the end of said sealing ring.

2. A hanger according to claim 1 wherein said engaging and force exerting means includes a pin extending through the wall of said body and being in threaded engagement therewith whereby said pin is moved inward and outward responsive to its rotation with respect to said body, said sleeve having a tapered surface, the inner end of said pin engaging said tapered surface so that inward movement of said pin wedges said sleeve in said direction of convergence to force said seal into tight sealing engagement.

3. A hanger according to claim 2, including means for sealing between said pin and said body.

4. A hanger according to claim 3 wherein said annular converging space is defined by a tapered surface on the interior of said body, and a tapered surface on the exterior of said tubular hanger.

5. A hanger comprising a body having a central bore with an upwardly facing seat therein, a tubular hanger positioned within said central bore on said seat, an annular downwardly converging space free of obstructions and located between the interior of said body and the exterior of said hanger, a metal seal ring in said annular space and freely movable downward therein until said seal ring engages the interior of said hanger and the exterior of said body, a sleeve around a portion of the exterior of said hanger, engaging said seal ring and slidable axially on said hanger, and means extending through the wall of said body engaging and exerting a force on said sleeve whereby said sleeve is driven downward until said seal ring is forced into sealing engagement between said hanger and said body, said sealing ring moving axially to sealing engagement with its inner and outer surfaces being maintained substantially parallel to the sides of said converging annular space and when in sealing engagement at least a portion of said converging annular space extending beyond the end of said sealing ring.

6. A hanger according to claim 4 including a seal flange, means securing said seal flange to said body, means for sealing between said seal flange and said body, and means for sealing between said seal flange and said hanger, said sealing means both being inert to temperature variations and extremes and to well fluids.

7. A hanger according to claim 5 wherein said sealing means and said metal seal ring are 316 stainless steel.

8. A hanger according to claim 4 including a control plug for connection to a control line and extending through said body and said sleeve into said hanger, said sleeve having a slot through which said control plug extends whereby the downward movement of said sleeve is not impeded by said control plug.

9. A hanger according to claim 7 wherein said annular downwardly converging space is defined by an upwardly facing tapered surface on the interior of said body, and an upwardly facing tapered surface on the exterior of said tubular hanger.

* * * * *